US006584884B1

(12) United States Patent
Duell

(10) Patent No.: US 6,584,884 B1
(45) Date of Patent: Jul. 1, 2003

(54) INTEGRAL VALVE-CYLINDER ASSEMBLY AND FORK POSITIONING SYSTEM

(75) Inventor: Charles A. Duell, Crestline, OH (US)

(73) Assignee: McClain Industries, Galion, OH (US)

( * ) Notice: Subject to any disclaimer, the term of this patent is extended or adjusted under 35 U.S.C. 154(b) by 102 days.

(21) Appl. No.: 09/820,256

(22) Filed: Mar. 28, 2001

(51) Int. Cl.[7] ..... F15B 13/044
(52) U.S. Cl. ..... 91/533; 91/459
(58) Field of Search ..... 91/394, 402, 409, 91/357, 450, 519, 533, 459; 60/477, 425

(56) References Cited

U.S. PATENT DOCUMENTS 3,150,857 A * 9/1964 Molloy ..... 60/425
4,630,442 A * 12/1986 Massaro et al. ..... 91/519
5,984,609 A 11/1999 Bartlett

OTHER PUBLICATIONS

EL Industries Inc. (1984). *Leach 2–F Front Loader* [Brochure]. (Available from EL Industries International, 2 North LaSalle Street, Chicago, IL 60602).

Peabody Galion Solid Wastes Systems (no date), *E–Z Pack FLSC Front Loader* [Brochure]. (Available from Peabody Galion Solid Wastes Systems, P.O. Box 607, Galion, OH 44833).

Peabody Galion Solid Wastes Systems (no date), *E–Z Pack Solid Arm Front Loader* [Brochure]. (Available from Peabody Galion Solid Wastes Systems, P.O. Box 607, Galion, OH 44833).

* cited by examiner

*Primary Examiner*—Edward K. Look
*Assistant Examiner*—Michael Leslie
(74) *Attorney, Agent, or Firm*—McDonnell Boehnen Hulbert & Berghoff

(57) ABSTRACT

An integral valve-cylinder assembly and a fork folding hydraulic system for front loading waste collection vehicles is provided that allows the forks to be full tucked for over-the-road travel and without exceeding the vehicle height limit that uses a multi-port hydraulic cylinder integrated with a remotely activated valve that is operated with a single control valve from within the vehicle cab.

4 Claims, 4 Drawing Sheets

INTEGRAL VALVE-CYLINDER ASSEMBLY AND FORK POSITIONING SYSTEM

FIELD OF THE INVENTION

My invention relates to an integral combination of a hydraulic cylinder and a remotely activated valve. In particular, my invention is directed to a cylinder-valve assembly that is useful as part of an improved fork positioning system for front end loading refuse vehicles. My invention allows the forks on a front-end loader to be stowed in a safe position during over-the-road travel.

BACKGROUND OF THE INVENTION

Hydraulic cylinders are used in numerous applications and find specific utility in the operation of heavy-duty commercial equipment and vehicles. In particular, refuse collection vehicles use a number of hydraulic cylinders to move the various mechanical parts of the vehicle. One particular type of refuse vehicle is the front-end loader which is used to pick-up and dump refuse or recycle bins and containers. Specific to front-end loaders is a pair of forks that are designed to engage a pair of lifting pockets normally located on the sides of a refuse container. These forks are pivotally connected to a pair of arms that raise the forks and the container up and over the top of the vehicle where the forks then rotate the container until its contents are dumped into a hopper located on top of the vehicle body. Once emptied, the procedure is reversed and the forks are rotated outwardly away from the vehicle and the arms are lowered to bring the container back to ground level. Both the forks and the arms are moved using hydraulic cylinders.

An important consideration in operating a front-end loader in over-the-road travel is to not exceed state and federal laws that regulate height limit for such vehicles. Currently, the law requires that no part of the vehicle exceed a height of 13½ ft. When the vehicle is operated in over-the-road travel, the operator will usually raise the arms back to their maximum position and rotate the forks towards the vehicle as far as possible. A problem arises if the forks are not tucked far enough back to a position sufficient to avoid exceeding the maximum height limitation as required by law. Those skilled in the art have suggested several methods to avoid this problem. In some cases the operator will position the forks in a folded second position by manipulating a mechanical means, such as a pendulum that normally is set to prevent full rotation of the forks during a dump cycle. A second known method involves the use of a four-ported cylinder where two sets of hydraulic lines are routed from each of the two cylinders attached to the forks along the perimeter of the lift arms, eventually making their way back to the vehicle body where they are connected to two solenoid valves. This complicated system allowed the forks to be set in two double positions. A first double position when fully extended and a second double position that allowed the forks to be fully rotated to meet the height requirement. A major problem with this design was the need for an excessive amount of hydraulic lines and corresponding hydraulic connectors. The wear and tear on these hydraulic lines and connectors caused by the up and down motion of the arms resulted in frequent maintenance and downtime of the vehicle. Yet another fork folding system is disclosed in U.S. Pat. No. 5,984,609 where a cylinder speed control mechanism is used to slow the piston speed severely during the dump cycle to avoid over rotating the forks and losing the trash container into the hopper. Other systems were also tried that involved various combinations of hydraulic and mechanical stops and cams, each with inherent problems related to maintenance and reliability.

Until my invention, no one in the art had devised a unique combination of a remotely operated valve connected directly to a multi-port hydraulic cylinder. My invention provides a fork folding system that is reliable and requires little maintenance as compared to prior art systems.

Accordingly, a primary object of my invention is to provide a hydraulic cylinder-valve assembly for use on commercial vehicles, in particular refuse vehicle that eliminates multiple hydraulic lines and avoids costly maintenance and downtime.

Another object is to provide a fork folding system that allows front-end loading refuse vehicles to meet the 13½ ft. height regulation for over-the-road travel.

Yet another object of my invention is to provide a fork folding system that can be activated by the vehicle operator without leaving the vehicle cab and by using a single control valve.

Other objects, features and advantages of the present invention will be apparent to those skilled in the art through familiarity with the discussion of the prior art, summary of the invention, detailed description, claims and drawings.

SUMMARY OF THE INVENTION

My invention overcomes the problems known to the art in operating hydraulic cylinders by providing an integral combination of a remotely operated valve and a double-acting hydraulic cylinder. The valve portion of the combination is connected directly to the cylinder body and is in direct fluid communication with two hydraulic fluid ports that partially control the extension and retraction of the cylinder plunger. By use of the term "port" I mean an opening in the cylinder where hydraulic fluid can flow into and out of the cylinder body. In addition to connecting directly with two ports on the cylinder, the valve is also connected via a single hydraulic line to a control value that in turn is connected to a control located in the vehicle cab that is manually operated by the vehicle operator. The control in the cab can be connected to the control value by a variety of means known to the air, including air, electrical or hydraulic. The internal workings of the valve are designed such that when it is in the closed position, one of the cylinder ports is sealed off from the other port and is capable of maintaining hydraulic pressure in a portion (or chamber) of the hydraulic cylinder. In this position, the valve prevents the cylinder plunger from fully retracting. When the valve is in the open position, both ports are in fluid communication with each other and the pressure can be relieved from the entire cylinder body allowing the plunger to fully retract.

The valve is opened and closed remotely, meaning that either an electrical signal or other means is used to activate the valve at a distance from the cylinder-valve assembly. Activation of the valve is typically from a normally open position to a closed position. In a preferred embodiment, the remotely activated valve is a solenoid valve that is activated by some remote means, preferably by a switch that is opened or closed either manually or automatically. In certain circumstances the switch can be opened or closed as a result of some predetermined condition occurring. When the hydraulic cylinder-valve assembly is used on a front end loading refuse vehicle the remotely activated valve can be activated by the vehicle operator from within the cab of the vehicle via a switch or through some other remote device that causes the valve to open or close. In effect, the valve allows the cylinder to retract to two positions—a dump position and a tucked position.

The dump position is the partially retracted position that prevents accidental loss of the refuse container into the vehicle hopper and greatly reduces the possibility of damage to the packer. The tucked position is when the cylinder is fully retracted and the attached forks are rotated back towards the top of the vehicle to avoid violating height regulations during over-the-road travel. In a particular preferred embodiment of my invention, a limit switch that is designed to sense a predetermined position of the arms during elevation over the vehicle remotely activates each of the valves connected to the cylinders causing them to close and thus prevent complete retraction of the cylinder plunger and complete rotation of the forks. The use of a limit switch provides a type of fail-safe mechanism that prevents the vehicle operator from accidentally rotating the forks to the tucked position during the dump cycle.

Detailed Description

Figure 1:
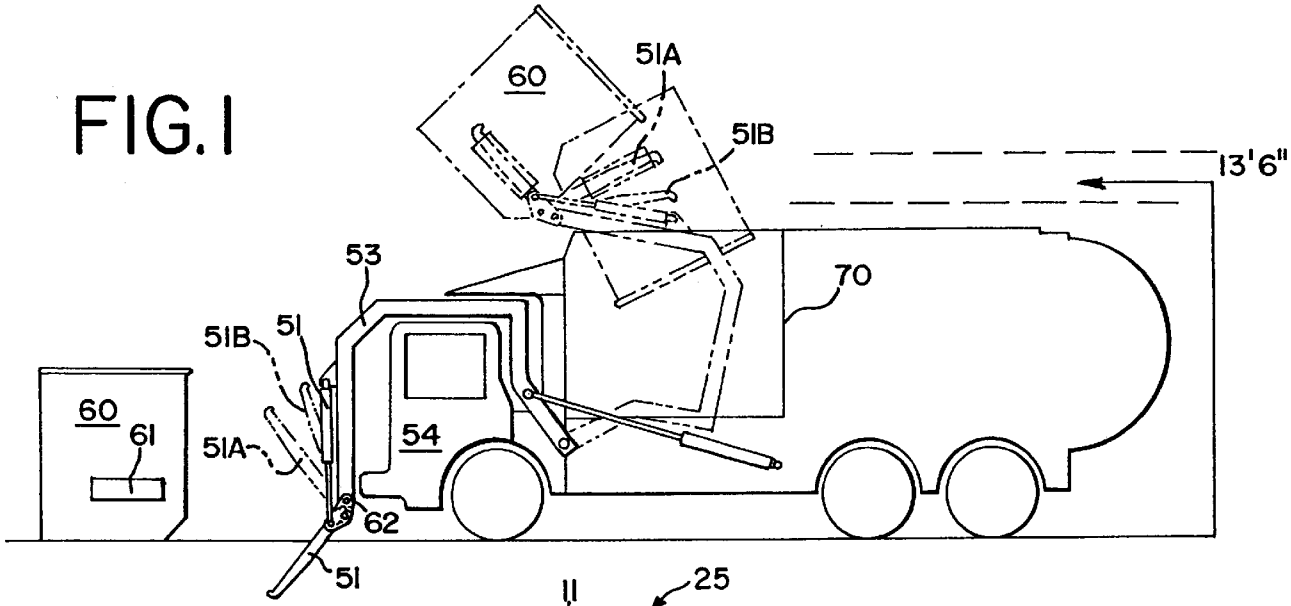
FIG. 1 shows a side view of front-loading refuse vehicle equipped with the fork folding system of my invention.

While my invention is susceptible of embodiment in many different forms, there is shown in the drawings and will be discussed below, specific embodiments with the understanding that the present disclosure is to be considered an exemplification of the principles of the invention and is not intended to limit my invention to the embodiment illustrated. In particular we have chosen to illustrate my invention of the unique combination of a remotely activated valve and hydraulic cylinder as applied to the operation of the forks on a front end loading refuse vehicle.

FIG. 1 illustrates a front end loading refuse vehicle 50 of the type typically used to collect and empty waste containers 60 from both residential and commercial locations. Forks 51 engage side-lifting pockets 61 on container 60 and in conjunction with arms 53, lift container 60 to a dump position over hopper 70. It should be noted that FIG. 1 shows only a side view of vehicle 50 and that the vehicle has two forks 51, two arms 53 and two hydraulic cylinder assemblies 52. Likewise, container 60 has lifting pockets 61 mounted to each side of the container. The operator of vehicle 50 sits in cab 54 and manually operates a control valve (not shown) that raises and lowers arms 53 and can simultaneously rotate forks 51 about pivot point 62. Forks 51 are connected to hydraulic cylinder assemblies 52. Cylinder assemblies 52, when extended, causes forks 51 to rotate about pivot point 62 outwardly and away from vehicle 50.

Figure 2:
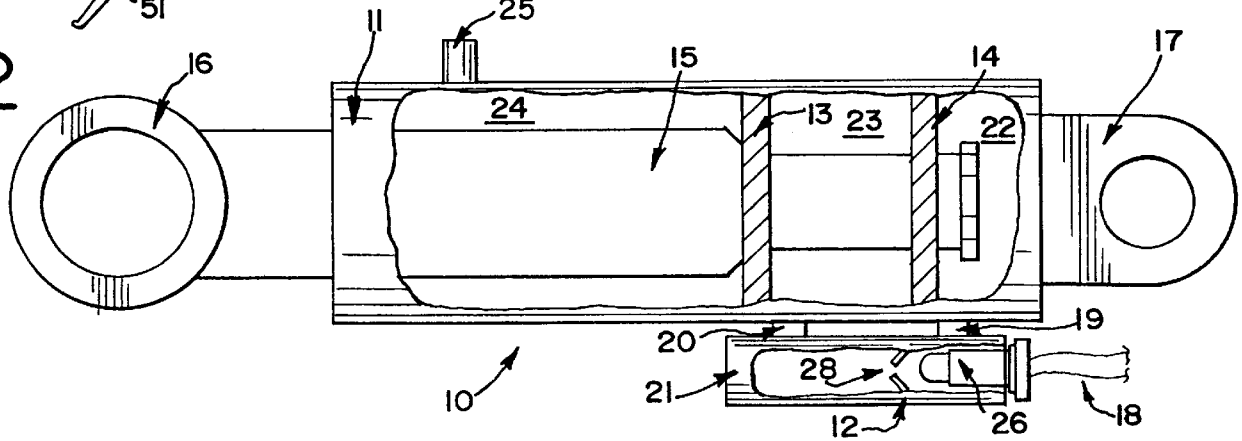
FIG. 2 is a sectional view of the cylinder and solenoid combination of my invention.
Figure 3:
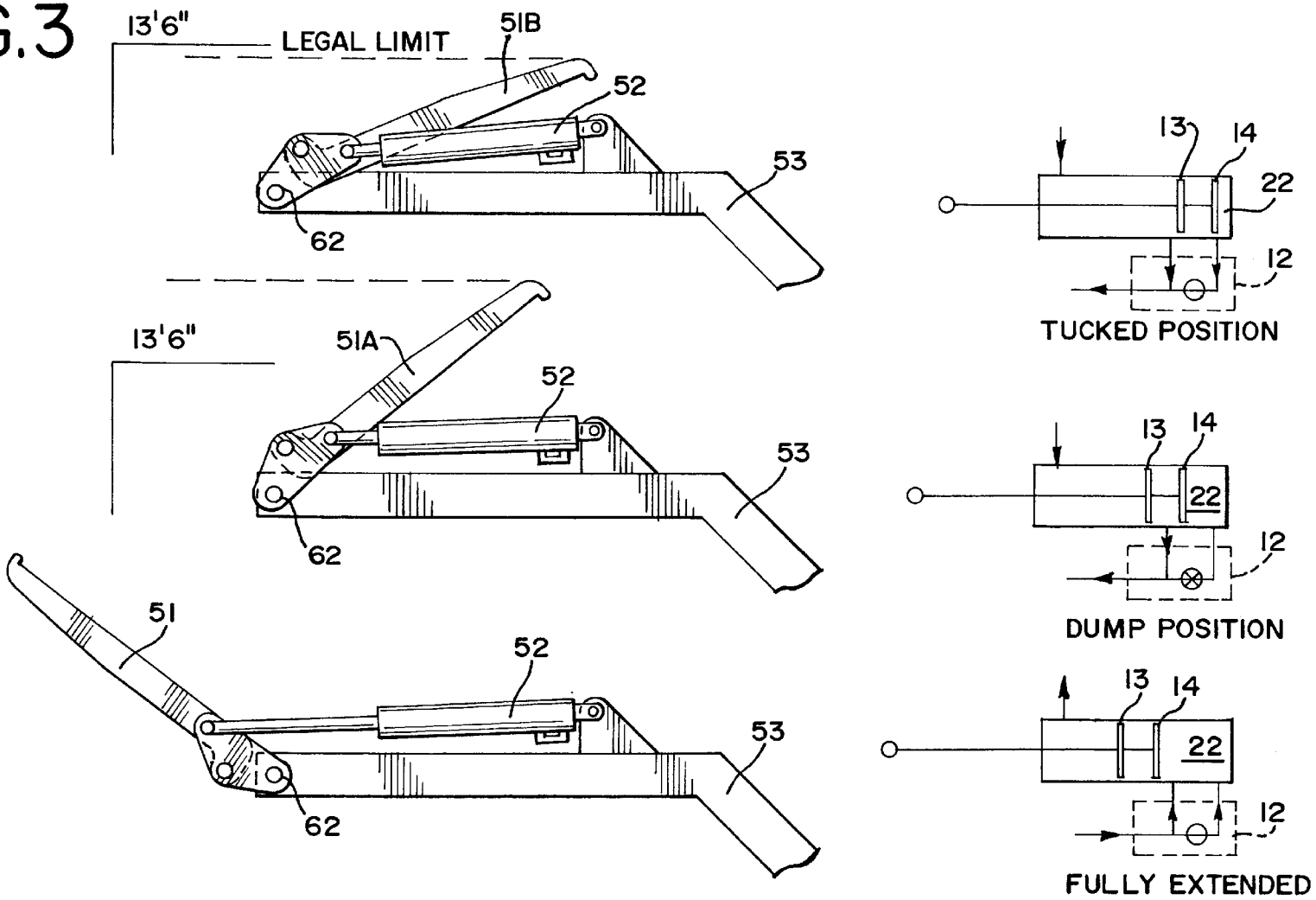
FIG. 3 is a schematic view showing the three positions of the cylinder and solenoid combination of my invention.

FIGS. 1 and 3 shows the three basic positions of forks 51; fully extended 51, a dump position 51A and a tucked position 51B. Position 51A is selected so that during the dump cycle container 60 is not inverted over hopper 70 at such an angle that will cause the container to slide off the forks and into hopper 70. The limited angle of rotation for dump position 51A also prevents container 60 from colliding with and damaging the internal surfaces of hopper 70. As shown in FIGS. 1 and 3, if the operator retracts the arms fully back and sets forks 51 to dump position 51A for over-the-road travel, the 13'6" legal height limit will be exceeded. To avoid exceeding the legal height limit, my invention allows forks 51 to be rotated to a tucked position 51B. When forks 51 are in tuck position 51 B and arms 53 are raised back and over cab 54 to their minimum position, the legal height requirement is met. The tucked position is possible because my invention uses a unique combination of a remotely activated valve connected directly to a hydraulic cylinder. This design eliminates the need for an excessive number of hydraulic lines and connectors because the valve is an integral component of the cylinder assembly. Referring now to FIG. 2 there is shown a cut-away view of one embodiment of my invention. Assembly 10 comprises a hydraulic cylinder body 11 directly attached to and in fluid communication with valve 12. The cutaway view of hydraulic cylinder body 11 reveals the internals of the cylinder, including two pistons 13 and 14, which are attached to plunger 15. At the end of plunger 15 is pineye bushing 16, which is designed to pivotally attach to fork 51. Opposite pineye bushing 16 is pineye lug 17, which is designed to attach to arm 53. The configuration of the hydraulic assembly illustrated in FIG. 2 would correspond to the forks being in the tucked position. In particular, reference should be made to FIG.3 to see the relative position of pistons 13 and 14 at each fork position. As hydraulic fluid pressure is increased through main extend port 20 and auxiliary port 19, pressure in chambers 22 and 23 builds causing plunger 15 to extend outwardly from cylinder body 11. Since pineye bushing 16 is connected to fork 51, the extension of plunger 15 pushes on fork 51 causing it to rotate outwardly about pivot point 62 on arm 53.

Remotely activated valve 12 can be connected through electrical wires 18 to a switch (not shown), which senses the relative position or height of arms 53. Alternatively, the valve can be activated by other remote means such as through radio frequency or infra-red transmission. Likewise, the valve can be opened or closed by a variety of different mechanisms, for example a simple electrical switch located in the vehicle cab can be manually operated by the vehicle operator or alternatively a remote control device can interact with the valve to place it in the open or closed position. A preferred embodiment is one where a limit switch is used as a fail safe device and is not manually controlled by the vehicle operator. In this case, the limit switch is designed such that when the arms are in a predetermined lowered position, an electrical signal is sent to valve 12 causing it to remain in an open position, as illustrated in FIG. 2. Many different types of valves can be used in my invention and the particular design is not critical provided that the valve chosen can maintain hydraulic pressure when in the closed position, thus securely blocking and isolating auxiliary port 19 from main extend port 20 and port 21. When valve 12 is in the open position, auxiliary port 19 is in open fluid communication with main extend port 20 and port 21. In this open position, hydraulic fluid contained in compartment 25 is free to flow through auxiliary port 19 into and out of port 21. When hydraulic fluid pressure is increased across retract port 22 while valve 12 is in the open position, hydraulic pressure is relieved through ports 19, 20 and 21, thus causing plunger 15 to fully retract. This fully retracted position would correspond to the tucked position as shown in FIGS. 1 and 3. Although the particulars of the internal design of the valve is not critical to my invention the valve must, however, operate to seal off the auxiliary port from ports 20 and 21.

A preferred embodiment of valve 12 is shown in FIG. 2. When valve 12 is in the closed position, valve stem 26 is seated in valve seat 28 thereby sealing off auxiliary port 19 from ports 20 and 21. In this closed position the hydraulic fluid and pressure is maintained in chamber 22 exerting pressure against piston 14, which in turn prevents plunger 15 from completely retracting. This incomplete retraction of plunger 15 would correspond to the dump position shown in FIGS. 1 and 3. As mentioned, a switch or other remote mechanism controls the opening and closing of valve 12. In the case of a limit switch, it is preferably located on the vehicle body in a position where it can sense or determine the relative position of the arms as they are raised or lowered by the vehicle operator. It is preferred that the limit switch is designed to sense when the arms reach a predetermined height during the dump cycle and then send a signal to the valve to close it. At any point before the arms reach the predetermined height position the limit switch is in the open position and the valve remains in an open position as illustrated in FIG. 2. This allows the refuse vehicle operator to use the control valve located in the vehicle cab to rotate the forks to the tucked position for over-the-road travel. Once the forks are fully rotated to the tucked position, the operator can then raise the arms back to their maximum position. If, however, the arms are raised above or past the predetermined height, the limit switch will close sending an electrical signal to the valve that will close it and prevent the forks from being rotated past the dump position. Thus, the limit switch acts as a fail-safe mechanism that prevents the operator from accidentally rotating the forks to the tuck position while a waste container is attached. This prevents the possibility of dropping a refuse container into the hopper. Alternatively, the valve can be positioned to be in communication with a main retract port and an auxiliary retract port. In this embodiment, only one extend port would be necessary.

Figure 4:
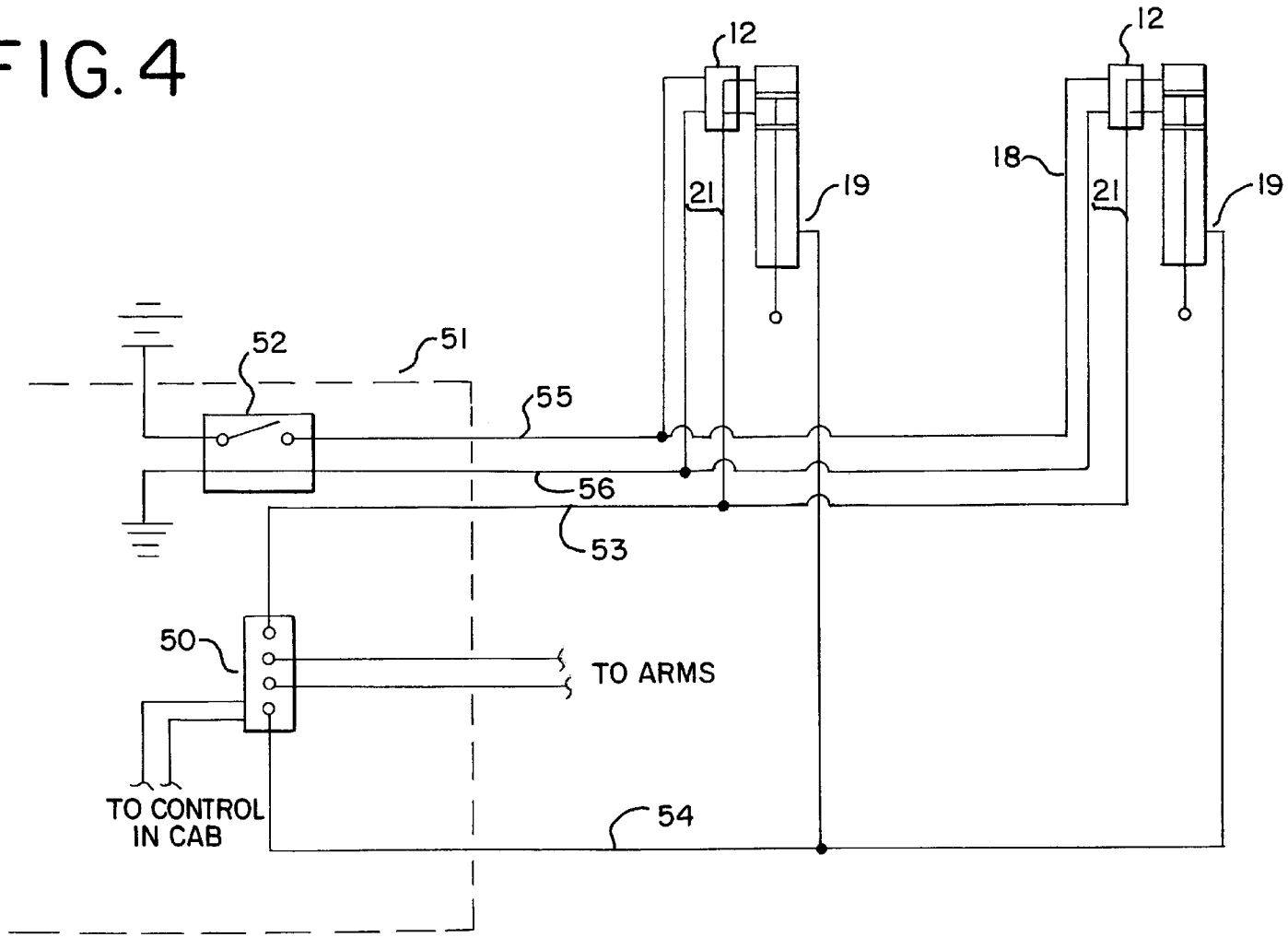
FIG. 4 is a schematic diagram showing the hydraulic and electrical connections of the fork folding system of my invention.
Figure 5:
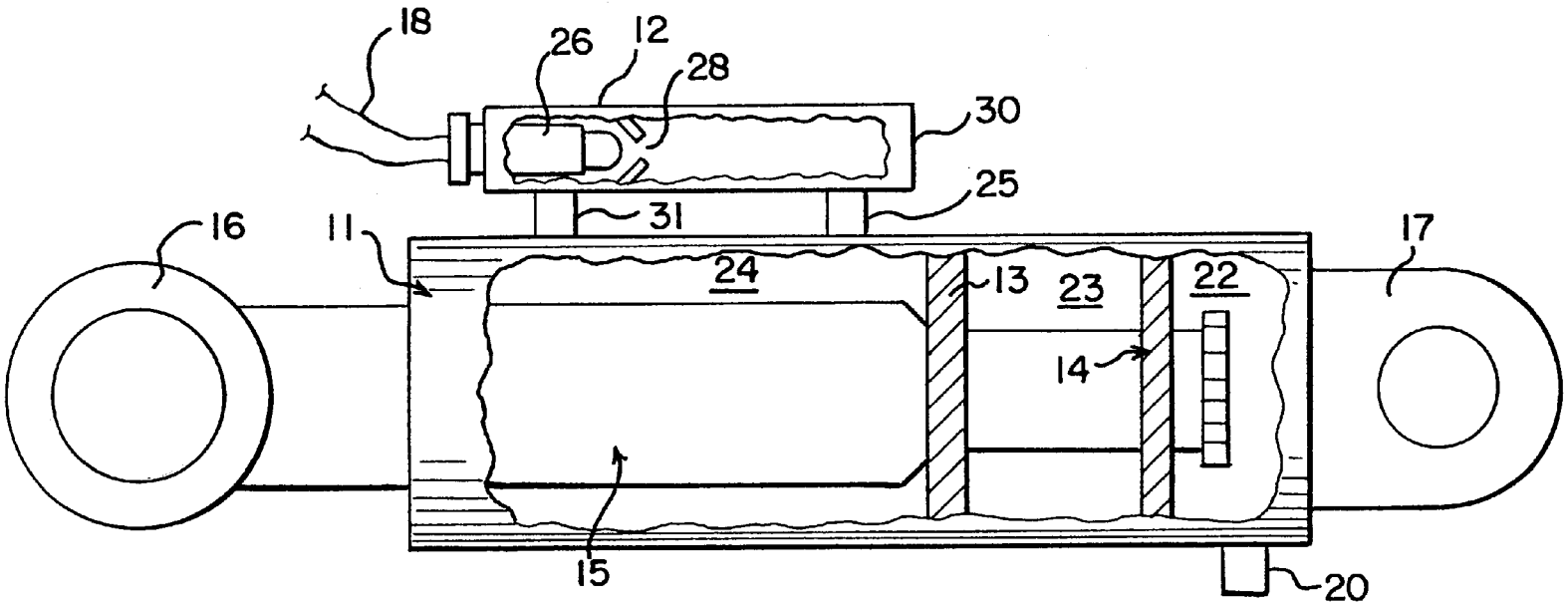
FIG. 5 is a section view of the cylinder and solenoid combination of my invention.

FIG. 4 presents a schematic diagram of one embodiment of my invention showing the electrical and hydraulic connections when a limit switch and solenoid valve are used. The dashed line 51 designates the front of the refuse vehicle. Control valve 50 is located on the vehicle body and is connected to a manually manipulated control in the vehicle cab (not shown) that is operated by the vehicle operator to control both the position of the forks and the arms. The control valve is connected to the cylinder assembly by hydraulic lines 53 and 54. Limit switch 52 is connected electrically to solenoid valve 12 through electrical wires 55 and 56.

Use of the cylinder-valve assembly and hydraulic fork folding system of the present invention and the attendant methods for waste collection which are provided by it, thus results in numerous advantages, many of which are mentioned above. It will be understood that the invention may be embodied in other specific forms without departing from its spirit or central characteristics. The above mentioned embodiments and figures, therefore, are to be considered in all respects as illustrative and not restrictive, and the invention is not to be limited to the details given here.

I claim:

1. A hydraulic cylinder assembly comprising, in combination, a) a cylinder body filled hydraulic fluid having a main extend port, an auxiliary extend port and an auxiliary chamber; and b) a two position remotely activated valve connected directly to the cylinder body and in fluid communication with the main extend port and the auxiliary extend port, whereby there is no flow of hydraulic fluid through the auxiliary port when the valve is in a closed position and when the valve is in an open position, hydraulic fluid flows into or out of the auxiliary chamber through the auxiliary port.

2. A hydraulic cylinder assembly comprising, in combination, a) a cylinder body filled hydraulic fluid having a main retract port, an auxiliary retract port and an auxiliary retract chamber; and b) a two position remotely activated valve connected directly to the cylinder body and in fluid communication with the main retract port and the auxiliary retract port, whereby there is no flow of hydraulic fluid through the auxiliary retract port when the valve is in a closed position and when the valve is in an open position, hydraulic fluid flows into or out of the auxiliary chamber through the auxiliary retract port.

3. The assembly of claim 1 wherein the remotely activated valve is a solenoid valve.

4. The assembly of claim 2 wherein the remotely activated valve is a solenoid valve.

* * * * *